US005686947A

United States Patent [19]

Murray et al.

[11] Patent Number: 5,686,947

[45] Date of Patent: Nov. 11, 1997

[54] INK JET PRINTER INCORPORATING HIGH VOLUME INK RESERVOIRS

[75] Inventors: Richard A. Murray; William M. Fries; David A. Purcell, all of San Diego, Calif.

[73] Assignee: ENCAD, Inc., San Diego, Calif.

[21] Appl. No.: 433,792

[22] Filed: May 3, 1995

[51] Int. Cl.[6] ..... B41J 2/175

[52] U.S. Cl. ..... 347/85

[58] Field of Search ..... 347/85, 86, 7, 347/87

[56] References Cited

U.S. PATENT DOCUMENTS

| | | | |
|---|---|---|---|
| 4,187,511 | 2/1980 | Robinson . | |
| 4,437,104 | 3/1984 | Hudson . | |
| 4,475,116 | 10/1984 | Sicking et al. . | |
| 4,831,389 | 5/1989 | Chan | 347/86 |
| 4,967,207 | 10/1990 | Ruder | 347/7 |
| 5,138,344 | 8/1992 | Ujita | 347/86 |
| 5,367,328 | 11/1994 | Erickson . | |
| 5,369,429 | 11/1994 | Erickson | 347/7 |
| 5,469,201 | 11/1995 | Erickson et al. | 347/85 |
| 5,512,926 | 4/1996 | Uchikata et al. | 347/86 |

*Primary Examiner*—Benjamin R. Fuller
*Assistant Examiner*—Judy Nguyen
*Attorney, Agent, or Firm*—Knobbe, Martens Olson & Bear

[57] ABSTRACT

An ink jet printer having an inking system that includes an ink jet cartridge, a large ink reservoir mounted inside the housing of the ink jet printer at a location which is remote from the ink jet cartridge and tubing connecting the ink reservoir to the ink jet cartridge. The large ink reservoirs may be pancake shaped, and may be stacked in side by side horizontal manner within the housing. A portion of the reservoir is transparent, and is visible to the operator for operator monitoring of ink level through openings in the printer housing placed in juxtaposition with the transparent portion of the large ink reservoirs.

18 Claims, 7 Drawing Sheets

INK JET PRINTER INCORPORATING HIGH VOLUME INK RESERVOIRS

FIELD OF THE INVENTION

The present invention relates to ink jet printers. In particular, the invention relates to ink jet printers having large-volume ink reservoirs mounted at a location remote from the print carriage.

BACKGROUND OF THE INVENTION

Ink jet printers and disposable ink jet cartridges for ink jet printers are well known in the art. Contemporary disposable ink jet cartridges typically include a self-contained ink reservoir, a jet plate assembly supporting a plurality of ink jet nozzles in combination with the ink reservoir and a plurality of external electrical contacts for connecting the ink jet nozzles to driver circuitry. Typically, the entire cartridge must be disposed of when the ink in the cartridge reservoir is used up without regard to whether or not the jet plate assembly remains fully functional.

For a thermal ink jet printer which contains multiple ink outlet nozzles, failure is usually caused by the failure of the resistors used to heat the ink in proximity to each nozzle. Due to relatively low resistor failure rates, the jet plate assemblies used in the currently available disposable ink jet cartridges are fully operable to their original print quality specifications after the original ink reservoir has been depleted. The contemporary disposable cartridge therefore represents a considerable waste of product resulting in higher costs to the consumer both in product cost and the time involved in having to frequently replace the cartridge.

Merely making the ink jet cartridge reservoir larger in size is not a satisfactory solution to problems associated with frequent replacement of or refilling of the ink jet cartridge. The ink jet cartridges are generally mounted on the moving print carriage of the ink jet printer. Therefore, the larger the volume of ink in the ink jet cartridge, the greater the amount of weight that is required to be moved by the printer carriage holding the ink jet cartridges. The additional weight of ink in the ink jet cartridges will cause significant demands on the motor that drives the printer carriage. Performance is also limited by heavier print carriages because a larger carriage inertia must be overcome at the two endpoints of carriage motion. At these locations, the carriage reverses direction to begin another pass over the media during the printing process. Increased carriage inertia increases the time required to reverse direction for a given drive motor size, and therefore can reduce print speed.

In addition, ink jet cartridges are typically mounted on one side of the print carriage and cause an unbalanced load which requires a counter balancing mechanism. Therefore, it is difficult to provide a larger volume of ink in the ink jet cartridges to limit the number of times that the cartridges need to be refilled with the power consumption and loading problems that larger ink volumes cause.

As a result, it is known in the art to manually replenish the ink within the disposable ink jet cartridge during the time period when the print quality from the jet plate is known to be high, but the original ink in the ink jet cartridge has been depleted. Manually refilling the disposable ink cartridges is, however, messy and difficult because many disposable ink jet cartridges are not designed with refilling in mind. More recently, some ink jet cartridges have been designed to enable refilling, such as the ink jet cartridge disclosed by in U.S. Pat. No. 5,280,300. These refillable ink jet cartridges are designed to enable refilling of the ink jet cartridge for a certain number of refills while the jet plate is still providing high quality printing capabilities. Making the cartridge easy to refill, however, does not mitigate the bother, time, and expense involved in having to refill this cartridge frequently.

Automatic refilling has also been contemplated. In U.S. Pat. No. 4,967,207 to Ruder, a system is disclosed which allows periodic refilling of the ink-jet cartridge at a "service station" provided at one extreme of carriage movement. In addition, various schemes of continuously supplying ink to the small reservoir in the disposable ink-jet cartridge from a larger reservoir located remote from the print carriage have been proposed. For example, U.S. Pat. No. 4,831,389 to Chan discloses large volume ink supplies connected through supply tubes to a foam containing ink-jet cartridge. The ink is continuously supplied to the ink-jet cartridge through capillary action as the ink in the cartridges is depleted.

U.S. Pat. Nos. 5,369,429 and 5,367,328 describe a system including a typical ink jet cartridge having an ink reservoir and a jet plate assembly mounted on a printer carriage, and an external reservoir system which refills the ink reservoir in the ink jet cartridge during printing. In the system disclosed in U.S. Pat. No. 5,369,429, the external ink reservoir, the ink jet cartridge, and the tubing connecting the external reservoir to the ink jet cartridge are configured to form a unitary single piece replaceable assembly. The volume of ink in the external reservoir is designed to be depleted when the print quality of the jet plate on the ink jet cartridge assembly has degraded to a level that may provide unsatisfactory printing results.

Systems such as those disclosed by U.S. Pat. No. 5,369,429, require the disposal of a large ink reservoir, an ink jet cartridge, and the tubing connecting the two once the ink in the large reservoir has been depleted. The waste and initial cost to the consumer therefore still exists for this type of system. Moreover, as the concerns over disposal of large quantities of plastic goods increases, such bulky disposable systems are not desirable. In addition, the unitary plastic assembly becomes contaminated by the ink and may not be suitable for conventional disposal. Also, the replacement of the unitary one-piece unit of the system described in U.S. Pat. No. 5,369,429 is difficult due to the size of the ink reservoir. Further, the tubing attached to the reservoir must be installed in the printer with care to ensure that it is properly positioned so as to not interfere with the moving parts of the printer.

A system using refillable remote ink reservoirs is available from VIP Systems in Belgium. This type of system helps alleviate the waste problems discussed above. In addition, the VIP Systems device is made almost entirely from clear plastic, allowing a certain degree of operator monitoring of ink level. However, as with the devices described in U.S. Pat. No. 5,369,429, this system is installed external to the printer housing and ink seepage and spills can interfere with operator monitoring of ink level. Also, the VIP Systems device incorporates a relatively complex priming system to remove air from the tubes when new ink-jet cartridges are installed. The complexity and external attachment of the VIP Systems device therefore renders it more expensive to produce and rather difficult to use.

SUMMARY OF THE INVENTION

The present invention is an ink jet printer which provides a continuous volume of ink to the moveable print carriage without suffering from the inconvenience of use, waste, cost and cumbersome disposal problems of the prior art systems.

Advantageously, the inking system comprises a plurality of small removable ink jet cartridges, each in fluid communication with a different one of a plurality of large ink reservoirs permanently mounted substantially within an end housing of the ink jet printer. Flexible tubing also permanently mounted within the ink jet printer connects each large reservoir to each ink-jet cartridge to enable the print carriage to move back and forth while maintaining a connection from the ink reservoir to the ink jet cartridge. The permanently mounted ink reservoir can be refilled with ink from time to time for the entire lifetime of the ink jet printer without needing to be replaced.

The ink-jet printer of the present invention provides substantial advantages over prior art systems because the large volume ink reservoirs are substantially internal to an end housing of the printer itself. Preferably, the large volume ink reservoirs are "pancake" shape, with width smaller than height and depth, and several are stacked horizontally in the end housing. This allows efficient use of space, and convenient means for expanding the number of large volume ink reservoirs provided with a printer.

Another significant feature of a preferred embodiment of the invention is that the level of ink in each large reservoir is conveniently visible from the front of the ink jet printer even though the reservoirs are substantially internal to the end housing. In one embodiment, a transparent portion of the large ink reservoirs is external to the end housing, while the remainder of the reservoir is internal to the housing. This feature renders the monitoring of the level of ink in each reservoir especially easy and convenient for the operator of the printer. Preferably, a transparent integral ridge provided on each of the large volume ink reservoirs comprises the portion of the reservoir which is external to the end housing. In this embodiment, the ridges protrude through vertical slots in the end housing, thereby also functioning to hold the reservoirs in place inside the housing.

Furthermore, when an ink-jet cartridge needs to be replaced because the cartridge has a finite life span during which the print quality is satisfactory, only the ink-jet cartridge needs to be replaced. The ink jet cartridge is removably mounted to the tubing via a quick disconnect fitting to enable easy replacement of the ink jet cartridge. Removal of the ink jet cartridge does not require the removal of other portions of the ink system. Therefore, the replacement of a cartridge is easy for the user and does not require replacement of other tubing or the large volume ink reservoir whose viable lifetime is much greater than that of the jet plate assembly. Thus, the ink supply system of the present invention substantially reduces waste, cost and disposal problems while providing a large volume of ink to the printer and maintaining high quality printing.

Advantages are also provided because the production cost of a preferred embodiment of the present invention is minimized by allowing ink to feed from the large volume reservoirs to the ink-jet cartridges by a siphon action through the connecting tubes, eliminating the need for pumps or pressure regulating devices. In this embodiment, the large volume ink reservoirs and their visible, ink level monitoring portions are positioned such that the level of ink in the large volume reservoirs changes from about two to about nine inches below the level of ink in the print cartridge as the reservoir is depleted from approximately full to approximately empty.

A further advantage of the invention is that the ink reservoir is refillable using simple procedures and is located such that refilling of the ink reservoir does not interfere with other moving parts of the ink jet printer. In addition, the ink reservoir is refillable during the normal operation of the printer, i.e., printing does not have to be halted in order to refill the ink reservoir.

DETAILED DESCRIPTION

Encad, Inc., the assignee of the present application, manufactures and sells a multi-color ink jet printer under the trade name of Nova Jet III which currently utilizes four prior art disposable ink jet cartridges. An operations manual of the Nova Jet III printer entitled "Nova Jet III User's Guide" (Encad Part No. 202409) is hereby incorporated by reference.

Figure 1:
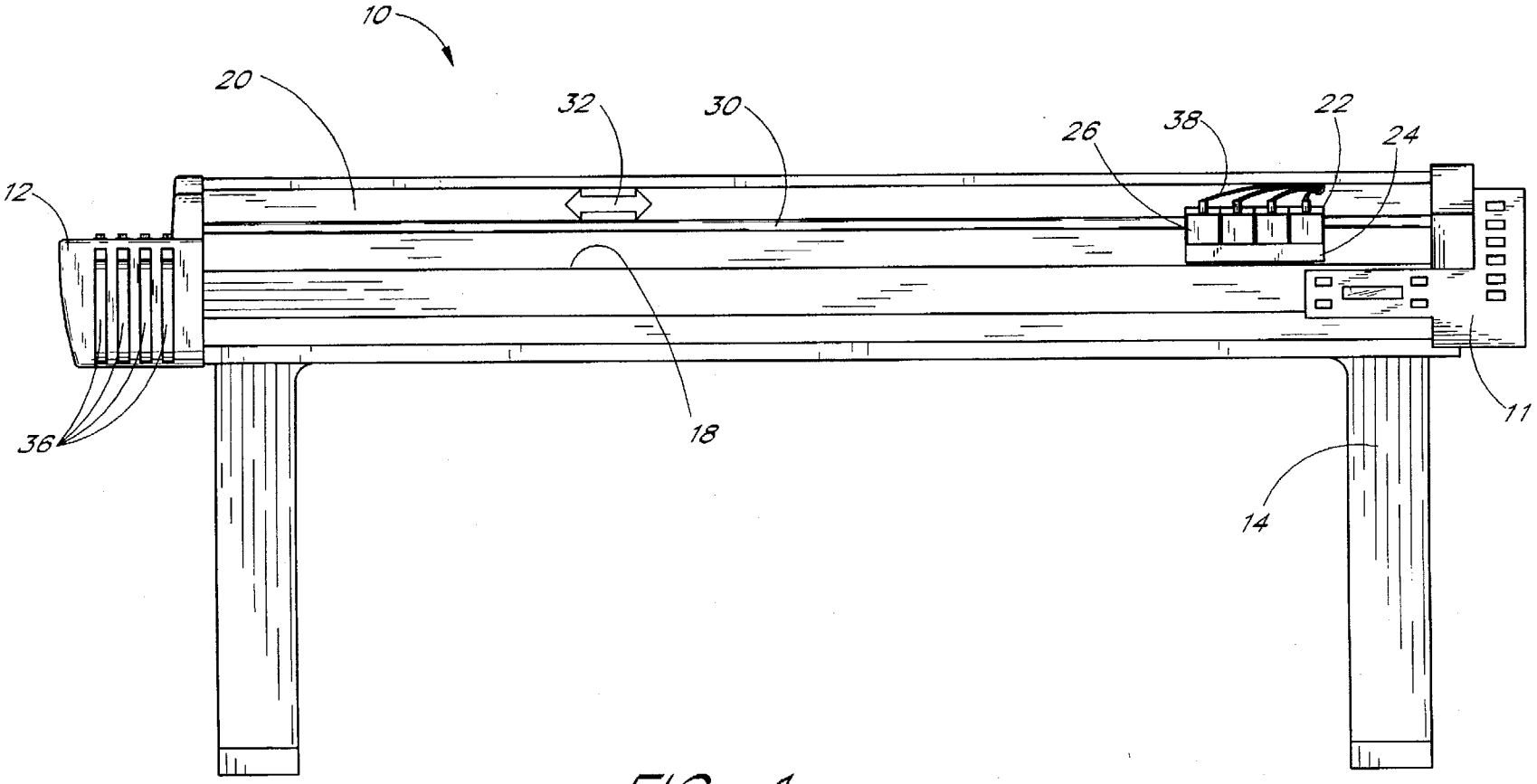
FIG. 1 is a front view of a large format ink jet printer incorporating large volume ink reservoirs according to the present invention.

The present invention is an improvement to the Nova Jet III by providing a large volume ink supply system for each of the ink jet cartridges. Referring to FIG. 1, a large format ink jet printer 10 includes left and right side housings 11,12, and is supported by a pair of legs 14. A "large format" ink-jet printer is typically floor standing, and is capable of printing on media larger than 18" in width. In contrast, a small format printer typically is suited for desk-top use, and prints on 8½"×11" or 11"×17" paper. The right housing 11, shown in FIG. 1 with a display and keypad for operator input and control, encloses various electrical and mechanical components related to the operation of the printer device, but not directly pertinent to the present invention. The left housing 12, described in more detail below in relation to FIGS. 2 and 3, encloses the large volume ink reservoirs which feed ink to the ink-jet cartridges 26, which are also described in more detail below.

Either a roll of continuous print media (not shown) is mounted to a roller on the rear of the printer 10 to enable a continuous supply of paper to be provided to the printer 10 or individual sheets of paper (not shown) are fed into the printer 10. A platen 18 forms a horizontal surface which supports the print media, and printing is performed by select deposition of ink droplets onto the paper. During operation, a continuous supply of paper is guided from the roll of paper mounted to the rear of the printer 10 across the platen 18 by a plurality of upper rollers (not shown) which are spaced along the platen 18. In an alternate embodiment, single sheets of paper or other print media are guided across the platen 18 by the rollers (not shown). A support structure 20 is suspended above the platen 18 and spans its length with sufficient clearance between the platen 18 and the support structure to enable a sheet of paper or other print media which is to be printed on to pass between the platen 18 and the support structure 20.

The support structure 20 supports a print carriage 22 above the platen 18. The print carriage 22 includes a plurality of ink-jet cartridge holders 24, each with a replaceable ink-jet cartridge 26 mounted therein. In a preferred embodiment, four print cartridges 26 are mounted in the holders 24 on the print carriage 22, although it is contemplated that more or less than four ink-jet cartridges 26 may be provided while utilizing the present invention. Each ink-jet cartridge 26 is provided with an integral ink storage reservoir of limited capacity, preferably containing approximately 20 to 40 ml of ink. Furthermore, each of these integral reservoirs preferably contains a different color of ink. In the four cartridge embodiment, these four reservoirs preferably contain black, magenta, cyan, and yellow ink.

The support structure 20 generally comprises a guide rod 30 positioned parallel to the platen 18. The print carriage 22 preferably comprises split sleeves which slidably engage the guide rod 30 to enable motion of the print carriage along the guide rod 30 to define a linear printing path, as shown by the bidirectional arrow 32, along which the print carriage 22 moves. A motor and a drive belt mechanism (not shown) are used to drive the print carriage 22 along the guide rod 30.

In accordance with the present invention, the ink reservoir inside each of the ink-jet cartridges 26 is in fluid communication with a large refillable ink reservoir 36, which is stationary with respect to the printer 10, and housed inside the left housing 12. The fluid communication is accomplished via plastic conduits 38, which run between each ink-jet cartridge 26 and each high volume ink reservoir 36. The conduits 38, which preferably comprise plastic tubing, are of a length sufficient to maintain the connection of the ink reservoir 36 to the ink jet cartridges 26 while the print carriage 22 moves along the length of the platen 18. Therefore, the length of the tubing 38 will vary depending upon the size of the plotter and the length of the platen 18. In a specific embodiment, the tubing 38 is has an outer diameter of 0.09 inches and an inner diameter of 0.05 inches. In specific embodiment of a D size plotter, the tubing length is 63 inches; in an E size plotter, the tubing length is 75 inches; and in a F size plotter, the tubing length is 87 inches.

Figure 2:
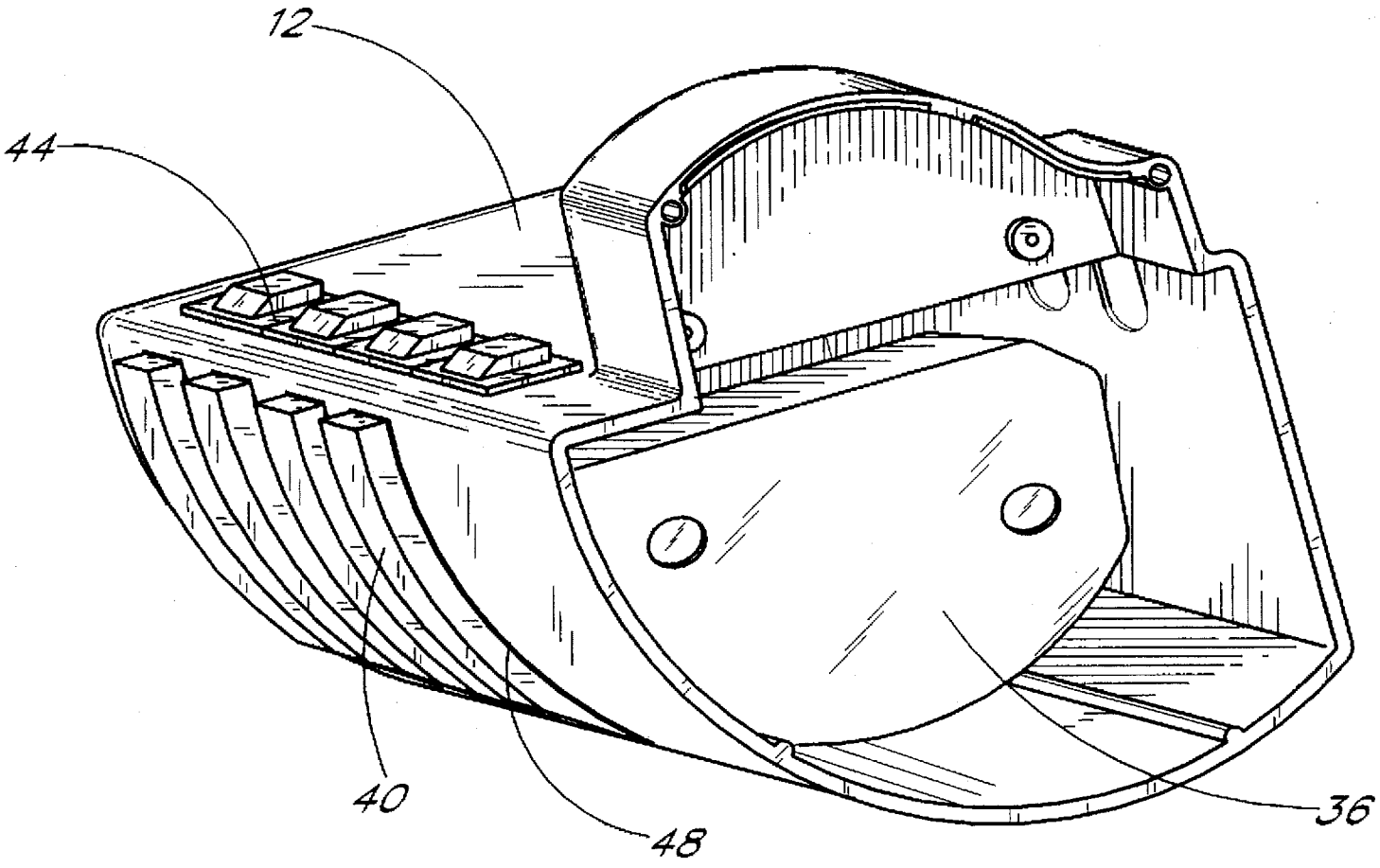
FIG. 2 is a perspective view of the printer housing incorporating internal large volume ink reservoirs.
Figure 3:
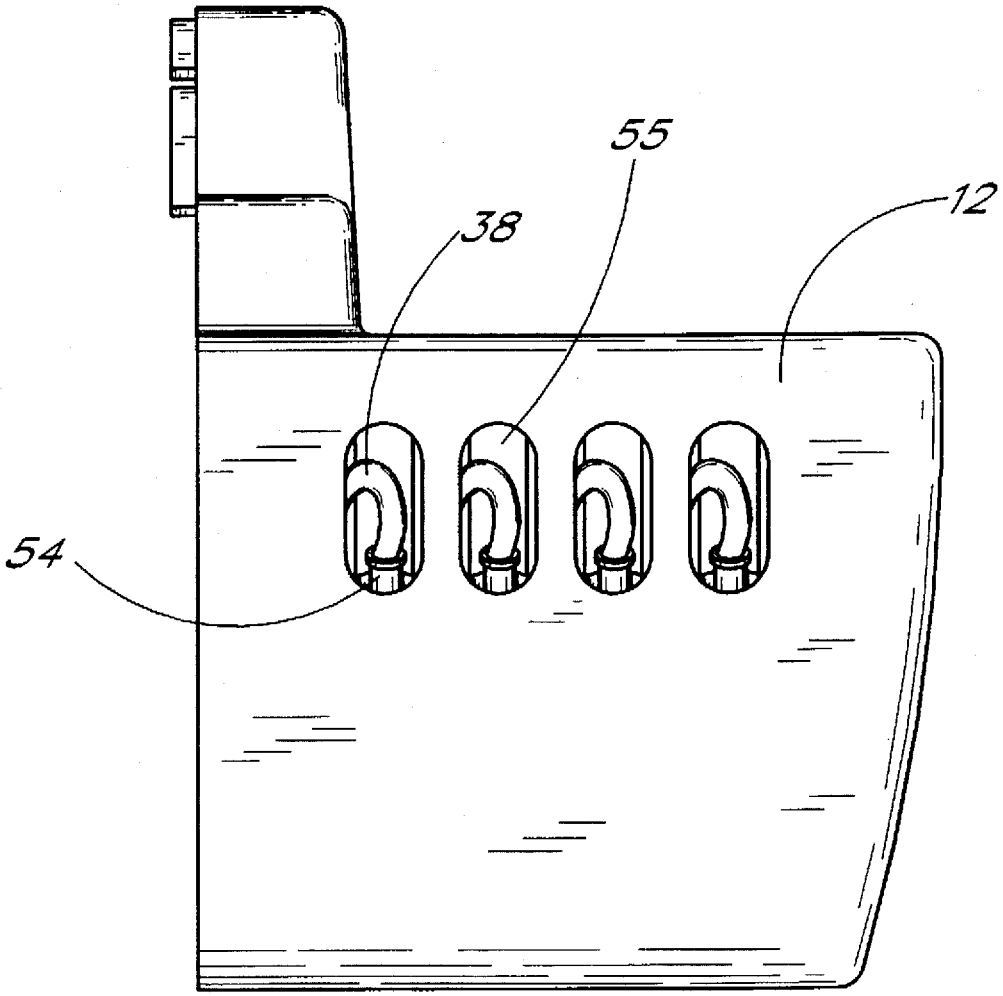
FIG. 3 is a rear view of the housing of FIG. 2.
Figure 4:
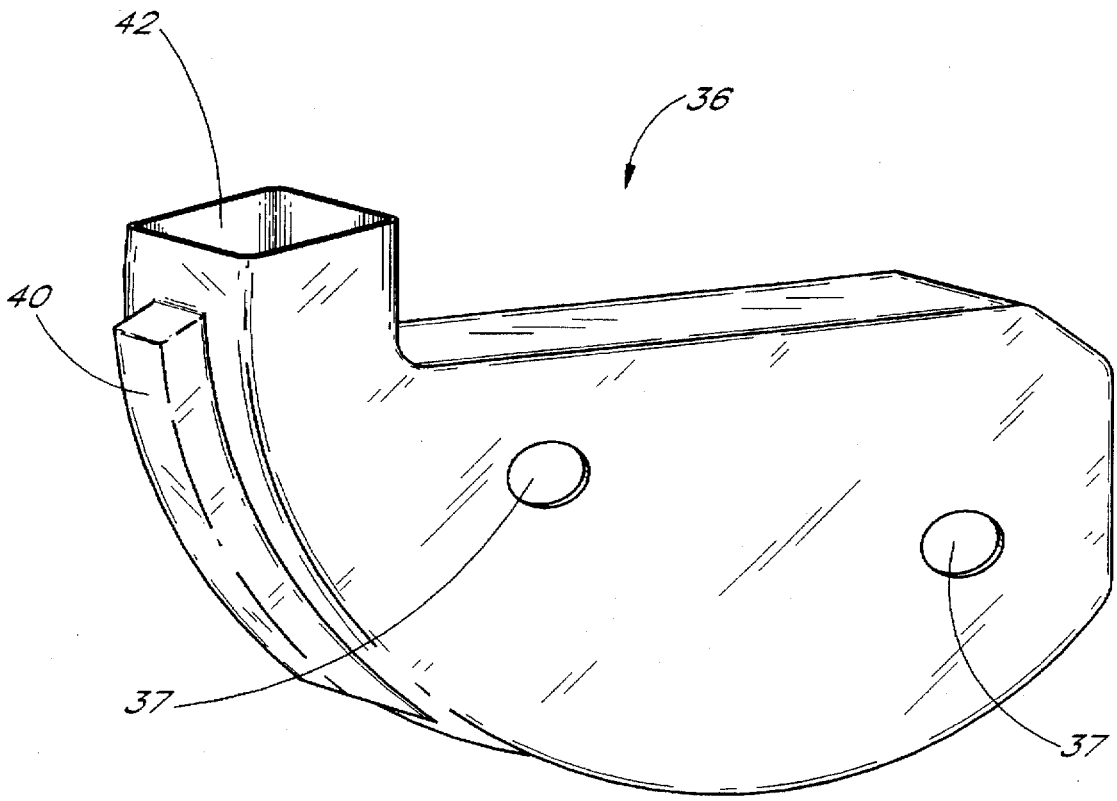
FIG. 4 is an overall perspective view of the ink reservoir according to the present invention outside the printer housing.

Because the ink reservoirs 36 are internal to the housing 12, it is apparent that each is preferably designed with reference to the other. To illustrate, the combination of reservoirs 36 and housing 12 is shown in FIGS. 2 and 3, and a perspective view of a reservoir 36 outside the end housing 12 is provided in FIG. 4. Each reservoir 36 preferably comprises a rounded bottom and front surface which substantially matches the rounded contour of the bottom and front of the housing 12. This allows the reservoirs 36 to rest stably on the inside surface of the housing 12, at a height suitable for producing an appropriate pressure differential between the ink in the large reservoir 36 and in the ink-jet cartridges, an aspect of the preferred embodiment of the present invention which is described in more detail below.

The volume of the reservoir 36 is preferably about 400 to 600 ml. This volume is convenient because it has been found that after depositing approximately this volume of ink, the ink jet cartridge is near the end of its a useful life in terms of acceptable print quality. Of course, reservoir 36 refilling may be performed at any time, without replacing the associated cartridge 26. If an operator therefore finds print quality from a given cartridge acceptable after depleting the full volume of the reservoir 36, it can be refilled at that time, and use of the same cartridge may continue indefinitely.

The width of each reservoir 36 is preferably small relative to the height and depth, rendering each a "pancake" shape. Although this tends to reduce the volume of ink a reservoir 36 of a particular overall size is capable of holding, it allows a lengthwise, side by side horizontal stacking of ink reservoirs inside the housing 12. This facilitates efficient use of space inside the housing, and allows increases in the number of ink reservoirs 36 (and therefore ink colors) without increasing the depth of the printer.

Preferably, the reservoirs 36 fit together side by side in a tongue and groove type configuration. This may be accomplished by providing two small circular slightly raised portions of reservoir wall on the left side of the reservoir 36, and substantially matching indentations 37 on the right side of the reservoir 36. When the reservoirs 36 are thus placed in side by side contact, the mating of the raised portions 37 with the complementary indentations on the adjacent reservoir forces them into stable alignment. The size and number of raised portions and matching indentations can be varied widely and still retain effectiveness. Reservoirs with a tight "snap-fit" engagement may also be created.

Each reservoir 36 is also provided with a top opening 42 for refilling the reservoir 36 when the ink is depleted. Normally, the reservoir opening 42 is covered by a friction secured cap 44 which is manually removable by an operator when refilling is desired. Preferably, the opening 42 is situated so as to be near the front of the printer 10 when the reservoir 36 is installed in the end housing 12.

Furthermore, the front wall of each reservoir 36 is formed so as to create an integral ridge 40. The ridge 40 has width less than the width of the reservoir 36, and extends vertically along the front surface of the reservoir 36 to the bottom surface of the reservoir 36. The integral ridge 40 of each reservoir 36 is sized to protrude through the slots 48 provided in the front of the housing 12. In the preferred embodiment of the present invention, the protruding ridge 40 comprises a transparent ink containing portion of the reservoir 36. Because ink fills the transparent ridge portion 40 as well as the rest of the reservoir 36, the ink level in the reservoir 36 is easily visible from the front of the ink-jet printer 10. In one embodiment, the ridge extends farthest from the surface of the reservoir 36 at its end nearest the top of the reservoir 36, and gradually decreases in height as it extends down along the sloping front and bottom portions of the reservoir 36. Consequently, when installed in end housing 12, the ridge protrudes furthest outward from the surface of the housing 12 at the top of the slot 48, and gradually decreases in extent of protrusion until blending into the interior of the housing 12 near the bottom surface.

The reservoir 36 may be made from a wide variety of materials. Material requirements include sufficient transparency for operator monitoring of ink level, and resistance to degradation in the presence of standard printer inks. For ease of manufacturing, the entire reservoir is preferably transparent, with transparent PVC and polycarbonate plastic being examples of suitable material.

Several advantages of this ink reservoir system are apparent. First, the ink level in each reservoir is easily monitored from the front of the ink-jet printer. Ink level monitoring does not require electrical or other remote sensing.

Furthermore, the fact that only a small portion of the reservoirs are visible from outside the printer housing reduces the visibility problems produced by the inevitable ink spills which occasionally occur with any refillable ink reservoir system. Preferably, monitoring convenience is further improved by marking or labeling the ridges 40 or the housing 12 adjacent to the ridges 40 to indicate appropriate ink levels for proper performance.

Proper functioning of the ink-jet cartridge requires that the pressure of the ink inside the ink exit nozzles of the cartridge be less than atmospheric pressure. When this is the case, the surface of the ink at the nozzle forms a slight concavity into the cartridge itself, until the surface tension of the ink balances the lower than atmospheric (i.e. "negative") pressure inside the cartridge. If the pressure in the cartridge is too high, the ink will bulge out of the nozzle, resulting in low print quality and ink leakage. If the pressure in the cartridge is too low, the concavity will extend too far into the cartridge, and insufficient ink will be delivered during firing. In order to ensure that the negative pressure in the ink-jet cartridge 26 relative to the pressure in the ink reservoir 36 is maintained, the ink reservoirs are mounted inside the housing 12 such that the ink level 35 in the reservoir 36 is maintained at a height differential of approximately 1.7 or 2 to 7, 8, or 9 inches below the ink level in the ink-jet cartridge 26. This causes the ink in the ink-jet cartridge 26 to be maintained at a negative pressure of between 2 in_$H_2O$ and 7 in_$H_2O$.

Figure 5:
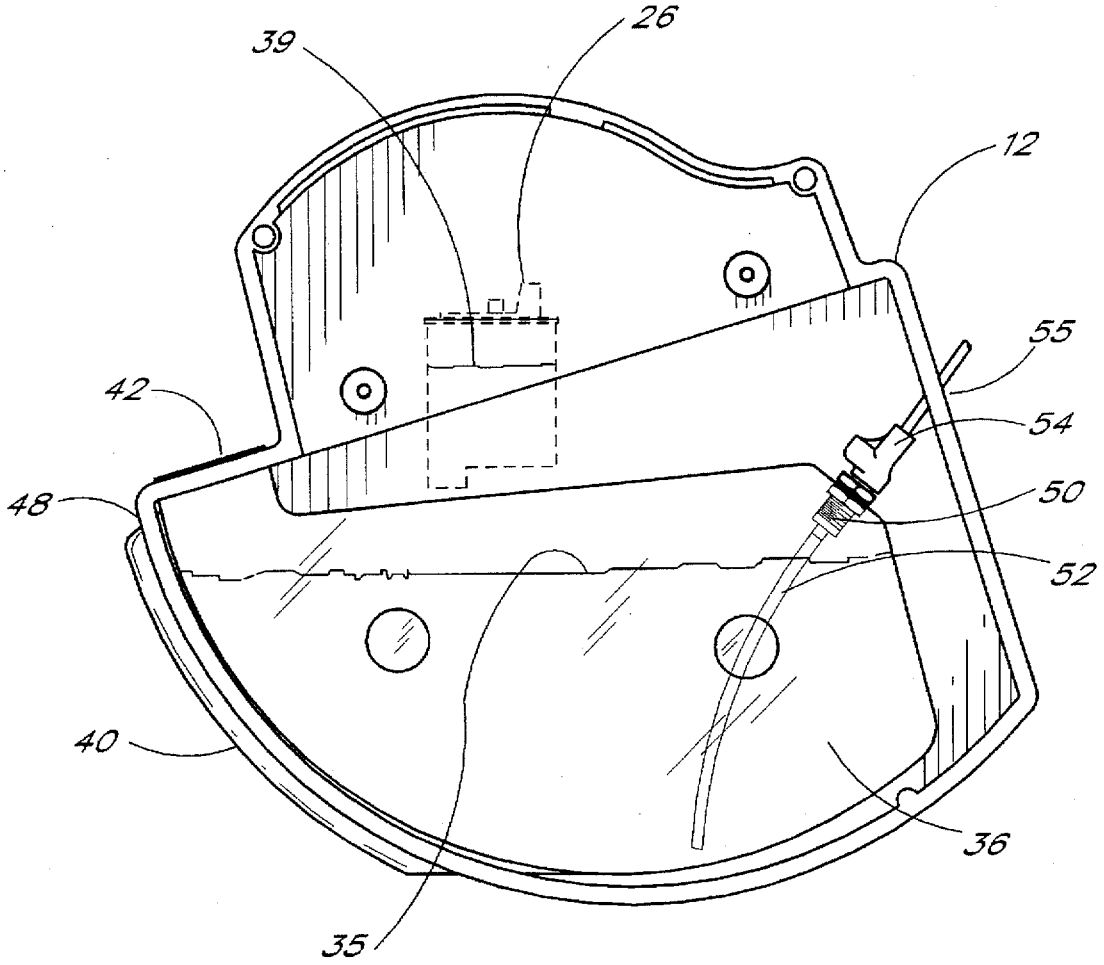
FIG. 5 is a cutaway side view of the printer housing incorporating internal large volume ink reservoirs.

Referring now to FIG. 5, the ink reservoirs 36 are preferably mounted in the housing 12 so that when the ink reservoirs 36 are full, the ink level 35 of the full ink reservoir 36 is two inches below the ink level 39 in the ink-jet cartridge 26. As the ink reservoir 36 is depleted, the height differential between the ink in the ink reservoir 36 and the ink-jet cartridge 26 will increase and, in the preferred embodiment, will not fall below approximately nine inches when the ink reservoir 36 approaches empty. To maintain constant atmospheric pressure inside the reservoir 36 as the ink is depleted, the upper rear portion of the reservoir 36 is provided with a small vent hole to allow the passage of air into and out of the reservoir 36.

Approximately opposite the ridge 40, on the upper rear portion of the reservoir 36, is an opening which incorporates a coupling insert 50, with one portion extending up and rearward from the rear wall of the reservoir 36, and a second portion extending into the reservoir 36. The insert 50 is a standard panel mount type, wherein the reservoir 36 wall around the rear opening is pinched between an integral hex and a nut on a threaded central portion. Inside the reservoir 36, the insert 50 comprises a hose barb connector over which a tube 52, preferably a polyurethane tube with ⅛ in. outer diameter and 1/16 in. inner diameter, is secured by friction. The tube 52 extends down into the ink inside the reservoir 36, and rests on the reservoir's 36 inside bottom surface. A commercially available insert, type PMC 42-01 from Colder Products Company in St. Paul, Minn. has been found suitable for this purpose.

The portion of the coupling insert 50 outside the reservoir 36 comprises a coupler portion which is adapted to mate with one side of a coupling body 54 which is attached to one end of the previously described plastic conduit 38. The coupling body 54 is secured to tubing 38 on a hose barb portion over which tubing 38 is fitted and secured by friction.

A valve is provided in the coupling body 54. This valve is in the closed position when the coupling body 54 is removed from the coupling insert 50, and in the open position when the coupling insert 50 and the coupling body 54 are engaged. This allows ink to flow from the reservoir to the ink-jet cartridge when engaged, and prevents any drainage of ink from the cartridge 26 out of the tube 38, or into the cartridge 26 from the tube 38 when the coupling body 54 and coupling insert 50 are disconnected. A suitable connecting body 54 containing a valve as described is commercially available as type PMCD 17-01 from Colder Products Company in St. Paul, Minn.

Access to the connecting insert 50 and connecting body 54 is provided by oblong openings 55, one for each reservoir 36, provided adjacent to each connecting insert 50 in the rear panel of end housing 12. Preferably, the tubes are made from transparent or translucent plastic. When this is the case, ink in the tubes 38 is visible where the tubing 38 is near the rear openings 55. Successful priming, an operation described in more detail below, can therefore be verified in part by observing the presence of ink in the tubing 38 near the reservoirs 36. In addition, if it is desired to replace a reservoir 36 or one of the tubes 38, it is easy to disengage the tubing 38 from the reservoir 36, minimizing the need for printer 10 disassembly.

From the connecting bodies 54, the tubes 38 extend up into the left end of the support structure 20 of the printer 10, where they are fed into one end of a bendable conduit router 60, preferably a hollow plastic chain, one end of which is fixed to the support structure 20 near the reservoir containing end housing 12. The chain is constructed with integral stops such that it will bend away from a linear configuration in only one of the two possible directions in the plane containing the axis of the chain. When the plastic tubes 38 are threaded through the interior portion of such a chain, they are constrained to bend only in the same manner as the chain. Such a chain is known to those in the art, and is available from Igus, in Germany. Igus type designation 05-1-018-0 has been found advantageous for a four reservoir embodiment with 0.09 in. outer diameter tubing 38 threaded inside.

Figure 6:
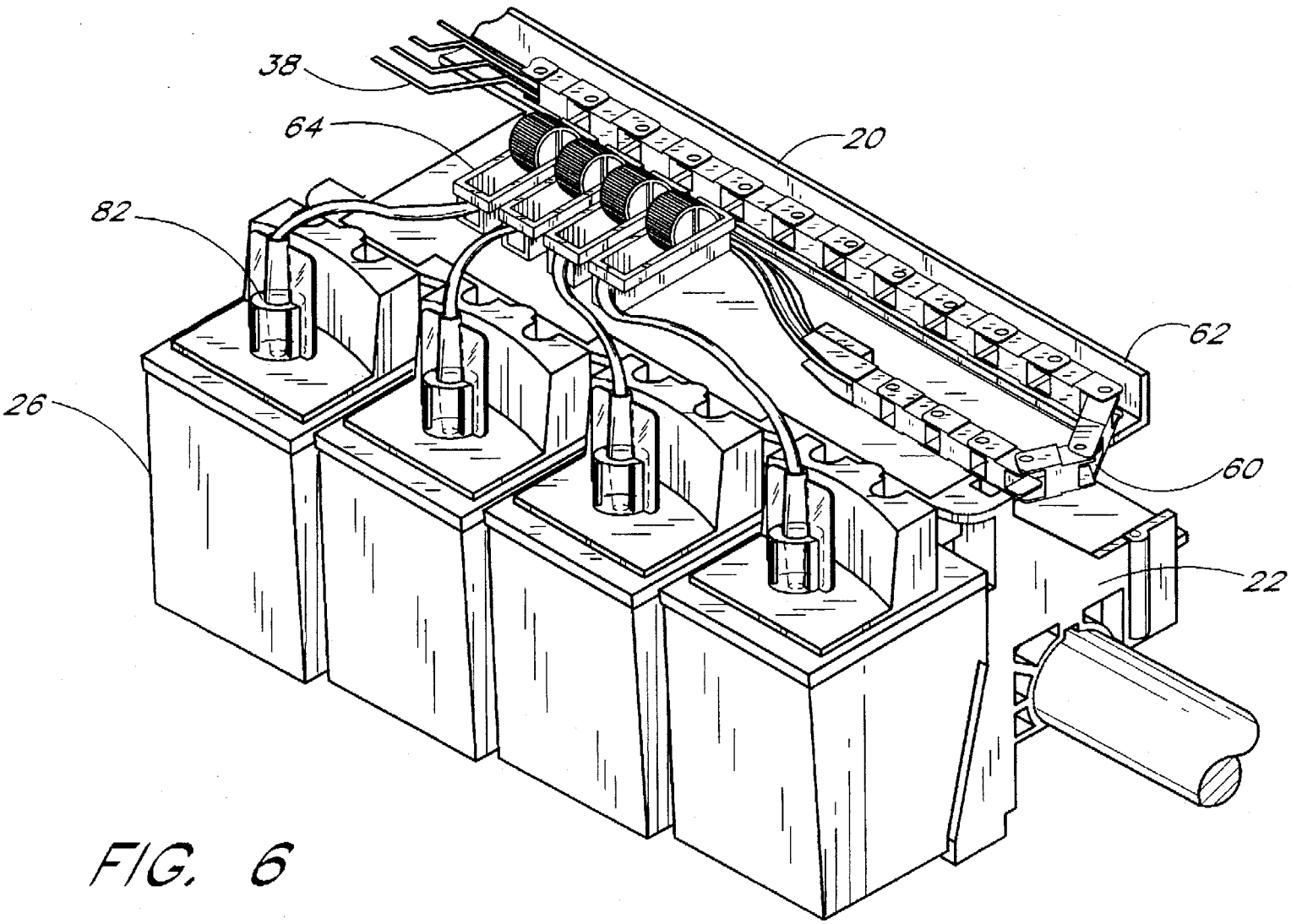
FIG. 6 is a perspective view of a portion of an ink jet printer with disposable ink jet cartridges being supplied ink by the remote large volume reservoirs.
Figure 10:
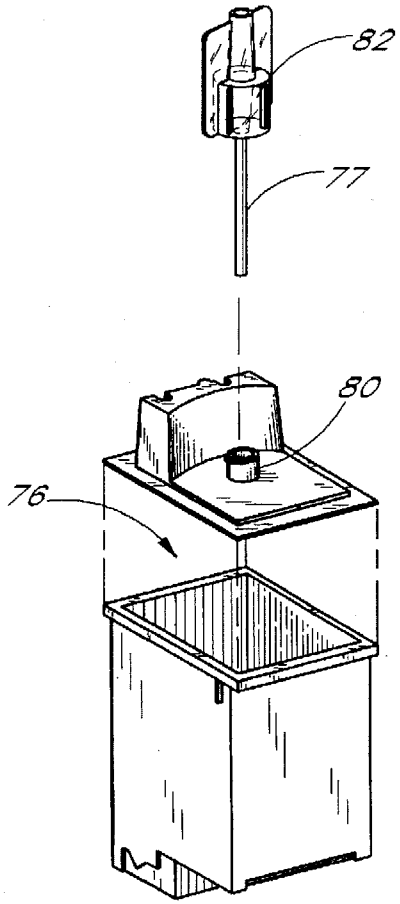
FIG. 10 is an exploded cutaway view of the ink jet cartridge depicted in FIG. 7.
Figure 8:
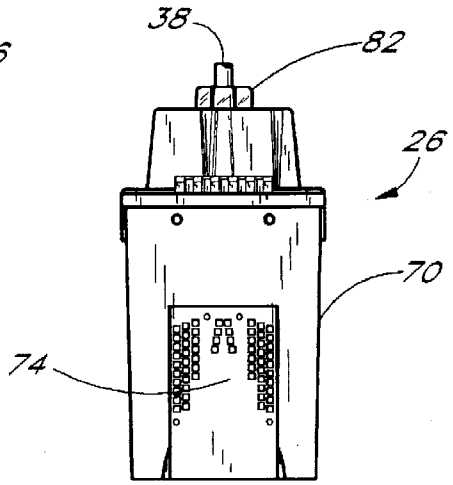
FIG. 8 is a rear view of the ink jet cartridge depicted in FIG. 7.
Figure 9:
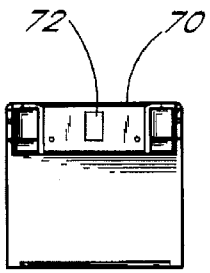
FIG. 9 is a bottom view of the ink jet cartridge depicted in FIG. 7.
Figure 7:
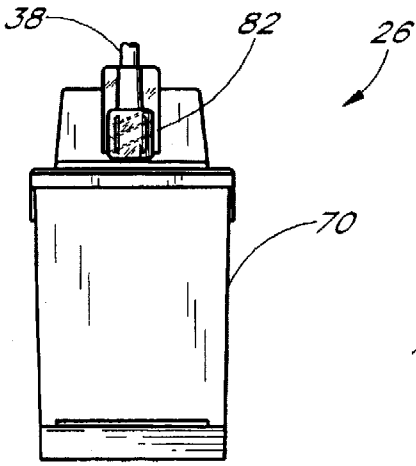
FIG. 7 is a detailed front view of an ink jet cartridge of the ink supply system of the present invention.

A perspective of the support structure 20, print carriage 22, and attached plastic Igus chain 60 threaded with tubing 38 is illustrated in FIG. 6. The other end of the Igus chain 60 is fixed to the print carriage, and therefore as the moveable print carriage is made to travel back and forth by a stepper motor and drive belt combination, the Igus chain 60 bends back and forth upon itself. Thus, the plastic tubing 38 threaded inside the chain 60 also bends back and forth upon itself within the chain, and therefore continues to smoothly feed ink from the stationary reservoirs 36 while the print carriage 22 moves back and forth along the support structure 20. Because the Igus chain 60 can make an unpleasant amount of noise in operation, it is preferable to place an adhesive backed foam pad 62 along the vertical surface of the support structure 20 that the chain links impact as the Igus chain 60 extends to a linear configuration. A preferable material is available from 3M in Minneapolis, Minn. as their part number Scotch VHB 4951. This is 0.045 in. thick closed cell acrylic foam tape with adhesive on both sides. The backing of one side is removed to expose the adhesive on that side and it is affixed to the support structure 20.

After exiting the chain 60 at the print carriage 22, each tube 38 is passed through an ink flow regulator 64, which is in the fully open position when the printer is configured for operation. The flow regulators 64 may be of any type which allows the operator to permit and prevent ink flow through the tubing 38 either into the cartridge 26, or back toward the reservoir 36. It has been found suitable to use roller clamps as shown in FIG. 6 which are well known to those in the art. In this clamp type, the tube 38 rests in a channel with a sloping floor. A moveable pressure wheel restricts flow by pinching the tube 38 when the wheel is positioned at one end of the channel, and allows flow through the tube 38 when the pressure wheel is positioned at the other end of the channel. A roller clamp suitable for this purpose is available from Qosina of Edgewood, N.Y., type number 14010.

After passing through the flow regulator 64, each tube 38 is routed to its respective ink jet cartridge 26. Details of the ink jet cartridges are illustrated in FIGS. 7 through 10. The ink jet cartridge 26 includes a cartridge housing 70, a jet plate 72, an electrical connector assembly 74, a limited capacity ink reservoir 76, with approximately 70 ml volume, and a quick disconnect fitting 80, which is preferably integral to the cartridge top panel. The cartridge 26 should not contain any foam insert in the internal ink reservoir, as some cartridges known in the art do. The presence of foam interferes with the siphon action necessary to the flow of ink from the reservoir 36 to the cartridge 26.

A preferred cartridge for use with the present invention is similar to those cartridges well known in the art such as the Body Print Head type 1040774 from Lexmark International Inc., in Lexington, Ky. However, modifications to this basic assembly are necessary because this cartridge is provided with a foam insert inside, and the top lid of the standard type 1040774 does not contain any opening for supplying ink from an external reservoir. Consequently, a cartridge for use with the present invention would comprise a housing 70 as in the type 1040774 without including a foam insert. However, the plastic top lid which is preferably ultrasonically welded to the housing 70 would be molded with an integral opening and fitting 80 allowing easy connection and disconnection of the tube 38 as is described in more detail below. The intergral fitting 80 in the top lid is preferably designed to standard female Luer Lock dimensions.

Preferably, the electrical connector assembly 74 is positioned on the cartridge housing 70 to align with a mating electrical connector assembly (not shown) on the print cartridge holder 24 as is conventional for ink jet printers. The connector assembly 74 transfers electrical control signals from the main control electronics in the printer housing 11 to the jet plate 72 to control the printing operation in a manner well known in the art.

The jet plate 72 includes a plurality of ink jet nozzles which may be conventional in design. Jet plate 72 is mounted to a bottom surface of the cartridge housing 70 and in alignment with the platen 18 such that the ink is ejected from the jet plate 72 for deposition onto paper or other print media which is positioned on the platen 18 below the ink jet cartridge 26.

The quick disconnect fitting 80 is utilized to removably connect the ink jet cartridge 26 to the tubing 38 to enable easy replacement of the cartridge 26. In a preferred embodiment, the end of the tubing 38 is connected to the top end of a male quick disconnect fitting 82 which mates with the female fitting 80 which is integral with the top lid of the cartridge 26. The bottom tip of the male fitting 82 is connected to one end of a connecting tube 77 and a hermetic seal is formed at this connection. The tube 77 is bonded to the male fitting 82 by conventional bonding methods known to those of skill in the art. Preferably, the connecting tube 77 is attached to the fitting 82 by an adhesive bond. In one embodiment, the connecting tube 77 comprises a stainless steel tube. In an alternate embodiment, the connecting tube 77 comprises a polyurethane tube.

Preferably, the quick disconnect fitting 82 is a conventional luer-lock fitting such as is available as Part No. 65105 from Qozina Company in Edgewood, N.Y. The quick disconnect fitting 82 advantageously enables the easy removal of the ink jet cartridge from the tubing 38. Thus, when the print quality of the jet plate 72 begins to degrade, the ink jet cartridge 26 can be easily removed and replaced with a new cartridge having a new jet plate 72. Preferably, the connection of the female end 80 integral to the cartridge with the male end 82 of the quick disconnect device includes the development of a hermetic seal between them when connected.

It should be noted that many types of cartridge 26 and connecting method between the cartridge 26 and the tubing 38 may be utilized with the present invention. An alternative embodiment utilizes the cartridges described in co-pending U.S. patent application Ser. No. 08/365,833, the disclosure of which is hereby incorporated by reference.

It can now be appreciated that the large volume ink storage system of the present invention includes several features which render it convenient for operator use. For instance, priming is easier and more convenient than in many prior art systems. As discussed briefly above, ink from the ink reservoir 36 is advantageously delivered to the ink jet cartridge 26 without any active components such as pumping devices. Preferably, the ink from the ink reservoir 36 is drawn through the tubing 38 by a siphon action through the tube 38 between the ink jet cartridge 26 and the ink reservoir 36 as the ink is expelled from the ink-jet cartridge and is deposited onto the media. In order to maintain the siphon, the tubing must be substantially free of air. Clearing the tubing 38 of excess air is the process of priming. To prime an air filled tube 38, the quick-connect fitting 82 on the cartridge is unscrewed and the attached connecting tube 77 is removed from the cartridge 26. A priming syringe is provided which terminates in a quick disconnect fitting which mates with the quick disconnect fitting 82 at the end of the tubes 38. The syringe fitting may, for example, be similar to the fitting 80 integral to the cartridge top panel. The connecting tube 77 is inserted into the syringe until the fitting 82 mates with the complementary fitting on the syringe. The plunger is then withdrawn, drawing ink through tubing 38 from the reservoir 36. When the ink reaches the connecting tube 77, priming is terminated, and the flow regulator 64 is moved into the closed position. The syringe is then removed from the connecting tube 77, and replaced into the cartridge 26, at which point the quick connect fitting 82 is re-tightened to the cartridge, and the flow regulator 64 is re-opened. As ink flows out of the cartridge 26 through the jet plate 72 during the printing process, it will be replaced by ink drawn from the reservoir 36 by the siphon action.

It can also be appreciated that when the ink-jet cartridge 26 is at the end of its useful life, only the ink-jet cartridge needs to be replaced. When cartridge 26 replacement is desired, the operator closes flow regulator 64, and disengages the quick connect fitting 82 on top of the cartridge to remove connecting tube 77. The connecting tube 77 is then placed into the new cartridge 26 which is placed in the holder 24 after removal of the old one. The flow regulator 64 may then be re-opened. Removal of the ink jet cartridge therefore does not require the removal of other portions of the ink system, and does not require repriming. Thus, the ink supply system of the present invention substantially reduces waste, cost and disposal problems while providing a large volume of ink to the printer and maintaining high quality printing.

The present invention may be embodied in other specific forms without departing from its spirit or essential characteristics. The described embodiments are to be considered in all respects only as illustrative and not restrictive. The scope of the invention is, therefore, indicated by the appended claims rather than the foregoing description. All changes which come within the meaning and range of equivalency of the claims are to be embraced within their scope.

What is claimed is:

1. A large format ink-jet printer comprising:

a plurality of replaceable ink-jet cartridges mounted in a moveable print carriage, said cartridges having a corresponding plurality of integral ink storage containers;

a plurality of stationary ink containers of substantially larger capacity than said integral ink storage containers and in fluid communication with said integral ink storage containers, wherein each of said stationary ink containers define an interior volume for storing ink and have:

(i) a substantially transparent portion through which said interior volume is visible; and, (ii) a generally pancake configuration having a height, a depth and a width, wherein said width is substantially smaller than said height and said depth thereof;

at least one housing substantially enclosing said plurality of stationary ink containers in a side by side horizontal stack configuration;

said housing comprising a plurality of upwardly extending openings, each of said openings aligned with said substantially transparent portion of said each of said stationary ink containers.

2. A large format ink-jet printer including a main enclosure that houses substantially all parts of said ink-jet printer, said ink-jet printer comprising:

a plurality of replaceable ink-jet cartridges mounted in a moveable print carriage, said cartridges having a corresponding plurality of integral ink storage containers;

a plurality of stationary ink containers of substantially larger capacity than said integral ink storage containers and in fluid communication with said integral ink storage containers;

a housing which forms an integral portion of said main enclosure, said housing substantially enclosing said plurality of stationary ink containers in a side by side horizontal stack configuration ; and, means for continuously monitoring an ink level in each of said stationary ink containers without opening said integral housing.

3. An ink-jet printer according to claim 2, wherein said means for continuously monitoring said ink level comprises a transparent ridge on said each of said stationary ink containers which protrudes through a slot in said housing such that said each of said stationary ink containers is held in place in said housing by said ridge, and wherein said ink level in one of said stationary ink containers is visible within said ridge.

4. A large format ink-jet printer including a main enclosure that houses substantially all ink-jet printer mechanisms, said ink-jet printer comprising:

a plurality of replaceable ink-jet cartridges mounted in a moveable print carriage, each of said cartridges having an integral ink storage container;

a plurality of stationary ink containers, each of said stationary ink container having a substantially larger capacity than said integral ink storage container and in fluid communication with said integral ink storage container; and, a housing which forms an integral portion of said main enclosure, said housing substantially enclosing said plurality of stationary ink containers in a side by side horizontal stack configuration.

5. An ink-jet printer according to claim 4, wherein said each of said stationary ink containers is pancake shape comprising a height, width, and depth, wherein said width is substantially smaller than said height or said depth.

6. The ink-jet printer of claim 5, wherein movement of said moveable carriage defines a substantially linear axis, and wherein said stationary ink containers are situated in a side by side configuration parallel to said substantially linear axis.

7. An ink-jet printer according to claim 4, wherein at least one integral ink storage container contains a quantity of ink having a first surface level, wherein at least one of said stationary ink containers contains a quantity of ink having a second surface level, and wherein said at least one of said stationary ink containers is positioned such that said second surface level is approximately two to nine inches below said first surface level.

8. An ink-jet printer according to claim 7, wherein a portion of said each of said stationary ink containers is visible through said housing.

9. An ink jet printer according to claim 8, wherein said each of said stationary ink containers provided with a transparent ridge which protrudes through a slot in said housing such that said each of said stationary ink containers is held in place in said housing by said ridge, and wherein said second surface level of said quantity of ink in said at least one of said stationary ink containers is visible within said ridge.

10. A large format ink-jet primer including a main enclosure that houses substantially all internal mechanisms of said ink-jet printer, said ink-jet printer comprising:

a plurality of replaceable ink-jet cartridges mounted in a moveable print carriage, each of said cartridges having an integral ink storage container;

a plurality of stationary ink containers, each of said stationary ink containers having a substantially larger capacity than said integral ink storage container and in fluid communication with said integral ink storage container; and, a housing integral to said main enclosure, wherein a portion of said each of said stationary ink containers is internal to said housing, and wherein a portion of said each or said stationary ink containers is external to said housing.

11. An ink-jet printer according to claim 10, wherein a substantially transparent portion of said each of said stationary ink containers is visible through said housing.

12. An ink-jet printer according to claim 10, wherein said each of said stationary ink containers is pancake shape having a height, a depth and a width wherein said width is substantially smaller than said height or said depth.

13. An ink-jet printer according to claim 12, wherein a portion of each of said stationary ink containers is visible through said housing.

14. An ink-jet printer according to claim 13, wherein said each of said stationary ink containers is provided with a corresponding ridge which protrudes through a slot in said housing such that said each of said stationary ink containers is held in place in said housing by said corresponding ridge.

15. An ink-jet printer according to claim 14, wherein at least one integral ink storage containers container contains a quantity of ink having a first surface level, wherein at least one of said stationary ink containers contains a quantity of ink having a second surface level, and wherein said at least one of said stationary ink containers is positioned such that said second surface level is approximately two to nine inches below said first surface level.

16. A large format ink-jet printer comprising:

a plurality of replaceable ink-jet cartridges mounted in a moveable print carriage, each of said cartridges having an integral ink storage container;

a plurality of stationary ink containers, each of said stationary ink containers having a substantially larger capacity than said integral ink storage container;

a plurality of conduits, each of said conduit in fluid communication between said integral ink storage container and a corresponding said each of said stationary ink containers;

a bendable conduit router for routing said plurality of conduits from said stationary ink containers to said integral ink storage containers, said plurality or conduits being constrained to move in conjunction with said conduit router as said print carriage moves, and wherein at least one side of a portion of said bendable conduit router abuts a solid guiding surface, said solid guiding surface constraining a direction of motion of said conduit router; and a noise dampening resilient material disposed between said bendable conduit router and said solid guiding surface.

17. The ink jet printer of claim 16 wherein said bendable conduit router comprises a substantially hollow plastic chain, and wherein a portion of said conduits are threaded within said chain.

18. The ink jet printer of claim 16 additionally comprising a housing integral to said in-jet printer, and wherein a portion of paid each of said stationary ink containers is internal to said housing, and wherein a portion of said each of said stationary ink containers is external to said housing.

* * * * *